US012091273B2

(12) United States Patent
Kubo

(10) Patent No.: US 12,091,273 B2
(45) Date of Patent: Sep. 17, 2024

(54) SHEET DISCHARGE APPARATUS AND IMAGE FORMING APPARATUS

(71) Applicant: CANON KABUSHIKI KAISHA, Tokyo (JP)

(72) Inventor: Shinji Kubo, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 466 days.

(21) Appl. No.: 16/929,181

(22) Filed: Jul. 15, 2020

(65) Prior Publication Data

US 2021/0039909 A1 Feb. 11, 2021

(30) Foreign Application Priority Data

Aug. 8, 2019 (JP) ..... 2019-146510

(51) Int. Cl.
*B65H 29/12* (2006.01)
*B65H 31/02* (2006.01)
*B65H 31/20* (2006.01)

(52) U.S. Cl.
CPC ..... *B65H 29/125* (2013.01); *B65H 31/02* (2013.01); *B65H 31/20* (2013.01); *B65H 2402/443* (2013.01); *B65H 2404/143* (2013.01); *B65H 2404/144* (2013.01); *B65H 2404/1521* (2013.01); *B65H 2405/11151* (2013.01); *B65H 2405/11164* (2013.01); *B65H 2405/1117* (2013.01); *B65H 2405/324* (2013.01);

(Continued)

(58) Field of Classification Search
None
See application file for complete search history.

(56) References Cited

U.S. PATENT DOCUMENTS 5,709,488 A * 1/1998 Imai ..... B41J 17/36 400/208
7,591,552 B2 * 9/2009 Takeshita ..... B41J 13/025 346/134

(Continued)

FOREIGN PATENT DOCUMENTS

JP H05-58527 A 3/1993
JP H05-186085 A 7/1993

(Continued)

OTHER PUBLICATIONS

Japanese Office Action dated Jun. 6, 2023, in related Japanese Patent Application No. 2019-146510.

*Primary Examiner* — Alejandro Valencia
(74) *Attorney, Agent, or Firm* — Venable LLP

(57) ABSTRACT

A sheet discharge apparatus includes a first conveyance guide having a plurality of first ribs and rotatably supporting a drive roller, with the plurality of first ribs guiding a sheet, and a second conveyance guide to support a holder member movably in a separating direction where the holder member separates from the drive roller. The second conveyance guide includes a plurality of second ribs which form a conveyance path, together with the first ribs, through which the sheet passes, and a regulation portion to regulate movement of the holder member within a range of a first distance in the separating direction from a position where a driven roller is in contact with the drive roller, wherein the first distance is smaller than a second distance which is a distance between the first ribs and the second ribs in the separating direction.

10 Claims, 11 Drawing Sheets

(52) U.S. Cl.
CPC .... *B65H 2601/325* (2013.01); *B65H 2801/06* (2013.01); *B65H 2801/12* (2013.01)

(56) References Cited

U.S. PATENT DOCUMENTS

| | | | | |
|---|---|---|---|---|
| 8,342,509 | B2 | 1/2013 | Takiguchi et al. | |
| 8,511,672 | B2 | 8/2013 | Kubo | |
| 8,777,397 | B2 * | 7/2014 | Iijima | B41J 3/4073 347/104 |
| 9,323,207 | B2 | 4/2016 | Nogami et al. | |
| 9,630,793 | B2 | 4/2017 | Kozaki | |

FOREIGN PATENT DOCUMENTS

| | | | |
|---|---|---|---|
| JP | 2006-199431 | A | 8/2006 |
| JP | 2008-162708 | A | 7/2008 |
| JP | 2011-85867 | A | 4/2011 |
| JP | 2015-069001 | A | 4/2015 |
| JP | 2015-209299 | A | 11/2015 |

* cited by examiner

SHEET DISCHARGE APPARATUS AND IMAGE FORMING APPARATUS

BACKGROUND OF THE INVENTION

Field of the Invention

The present invention relates to a sheet discharge apparatus to discharge a sheet, and an image forming apparatus which employs the sheet discharge apparatus.

Description of the Related Art

An image forming apparatus, such as a printer, including a sheet discharge apparatus which discharges a sheet with a toner image formed thereon is commonly known. Hitherto, the sheet discharge apparatus which includes a discharge roller, a press roller pair, which is rotatably driven by the discharge roller, and a roller holder, which holds the press roller pair in pressure contact with the discharge roller, has been disclosed (refer to Japanese Patent Laid-Open No. H05-58527).

However, there is a possibility in the sheet discharge apparatus described in Japanese Patent Laid-Open No. H05-58527 that, when a large external force acts on a discharge port from which the sheet is discharged outside, an upper guide of a conveyance path which includes the discharge port comes close to a lower guide and the conveyance path is narrowed. Thus, there was a problem that a conveyed sheet clogs the conveyance path and is brought into a jam.

SUMMARY OF THE INVENTION

According to one aspect of the present invention, a sheet discharge apparatus includes a discharge roller pair configured to discharge a sheet, the discharge roller pair including a drive roller driven by a drive source and a driven roller rotatably driven by the drive roller, a holder member configured to rotatably hold the driven roller, a first conveyance guide including a first guide portion and configured to rotatably support the drive roller, a second conveyance guide configured to support the holder member movably in a separating direction where the holder member separates from the drive roller, the second conveyance guide including a second guide portion which forms a conveyance path, together with the first conveyance guide, through which the sheet passes, and a regulation portion configured to regulate a movement of the holder member to be movable within a range of a first distance in the separating direction from a position where the driven roller is in contact with the drive roller, wherein the first distance is smaller than a second distance which is a distance between the first guide portion and the second guide portion in the separating direction.

Further features of the present invention will become apparent from the following description of exemplary embodiments with reference to the attached drawings.

DESCRIPTION OF THE EMBODIMENTS

First Embodiment

General Configuration

Figure 1:
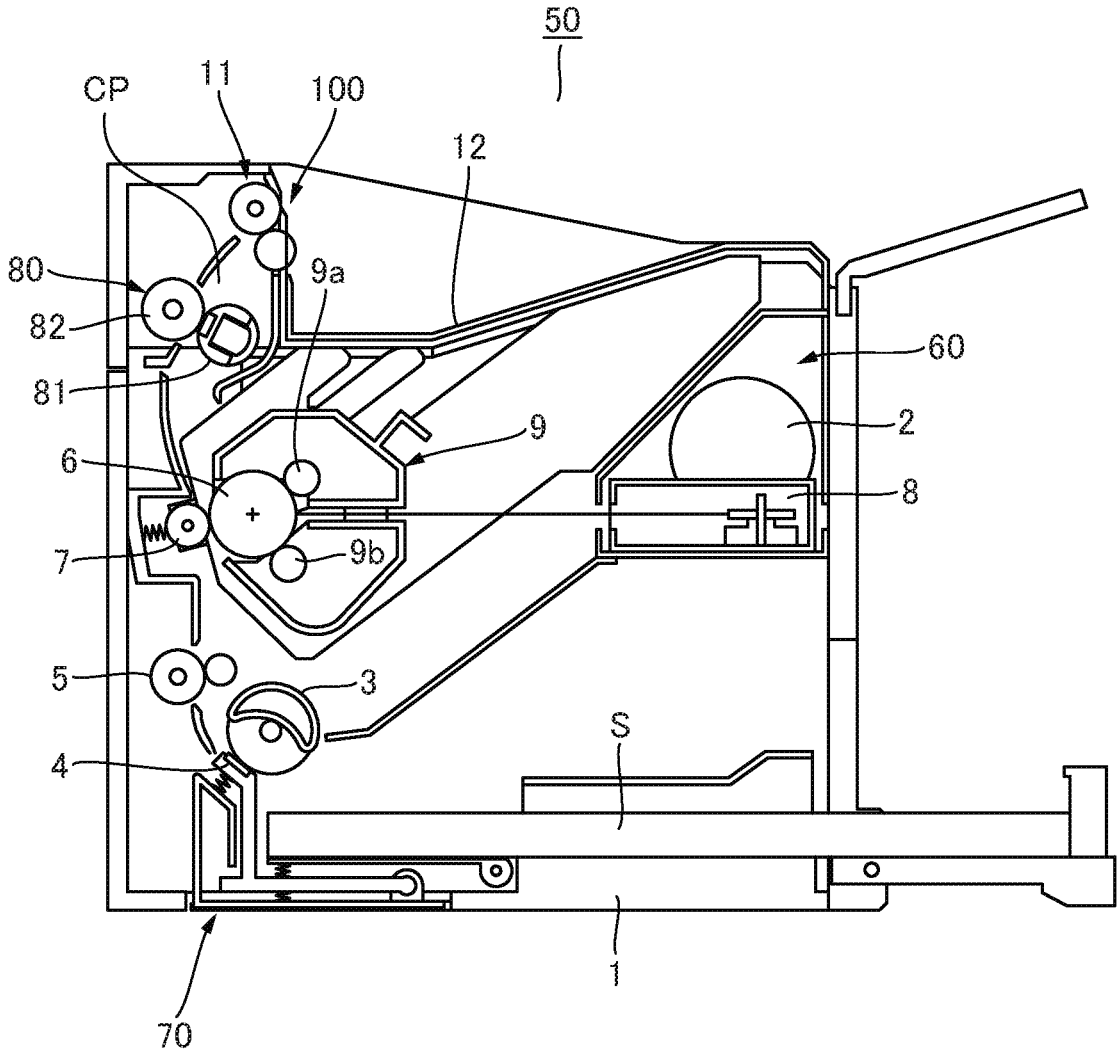
FIG. 1 is a general schematic view of a printer according to a first embodiment.

First, a first embodiment of the present invention will be described. A printer 50 according to the first embodiment is a laser beam printer of an electrophotographic system. As shown in FIG. 1, the printer 50 includes a sheet feed unit 70, which is capable to feed a sheet, an image forming unit 60, which forms an image on the sheet fed from the sheet feed unit 70, a fixing unit 80, and a sheet discharge apparatus 100.

When an instruction to form the image is output to the printer 50, the image forming unit 60 starts an image forming process based on image information input from an external computer and the like coupled to the printer 50. The image forming unit 60 includes a cartridge 9 which has a photosensitive drum 6 to bear the image, a laser scanner 8, and a transfer roller 7. The laser scanner 8 irradiates the photosensitive drum 6 with a laser beam based on the input image information. At this time, the photosensitive drum 6 has been charged with a charge roller 9*a* beforehand, and an electrostatic latent image is formed on the photosensitive drum 6 by irradiation of the laser beam. Thereafter, this electrostatic latent image is developed by a developing roller 9*b*, and a toner image is formed on the photosensitive drum 6.

In parallel with the image forming process described above, the sheet Sis fed from the sheet feed unit 70. The sheet feed unit 70 includes a stacker unit 1 on which the sheet S is stacked, a feed roller 3 which feeds the sheet S stacked on the stacker unit 1, a separation pad 4 which separates the sheet S fed by the feed roller 3 one at a time. The feed roller 3 is driven by a drive motor 2. To be noted, it is acceptable to use a separation roller or a separation slant face instead of the separation pad 4.

The sheet S fed from the sheet feed unit 70 is conveyed to the transfer roller 7 by a conveyance roller pair 5. The transfer roller 7 transfers the toner image formed on the photosensitive drum 6 to the sheet S by being applied with a transfer bias.

The sheet S on which the toner image has been transferred by the transfer roller 7 is treated with heat and pressure by the fixing unit 80 consisting of a heating roller 81 and a press roller 82, and the toner image is fixed. Then, the sheet S is discharged to a sheet discharge tray 12 by a sheet discharge roller pair 11 of the sheet discharge apparatus 100.

Sheet Discharge Apparatus

Figure 2:
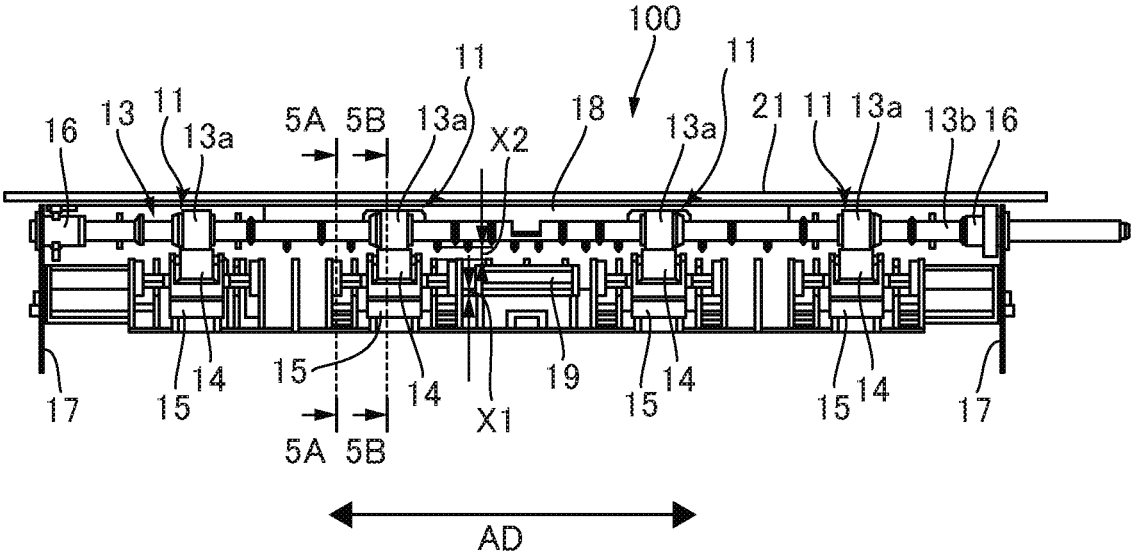
FIG. 2 is a front view of a sheet discharge apparatus.
Figure 3:
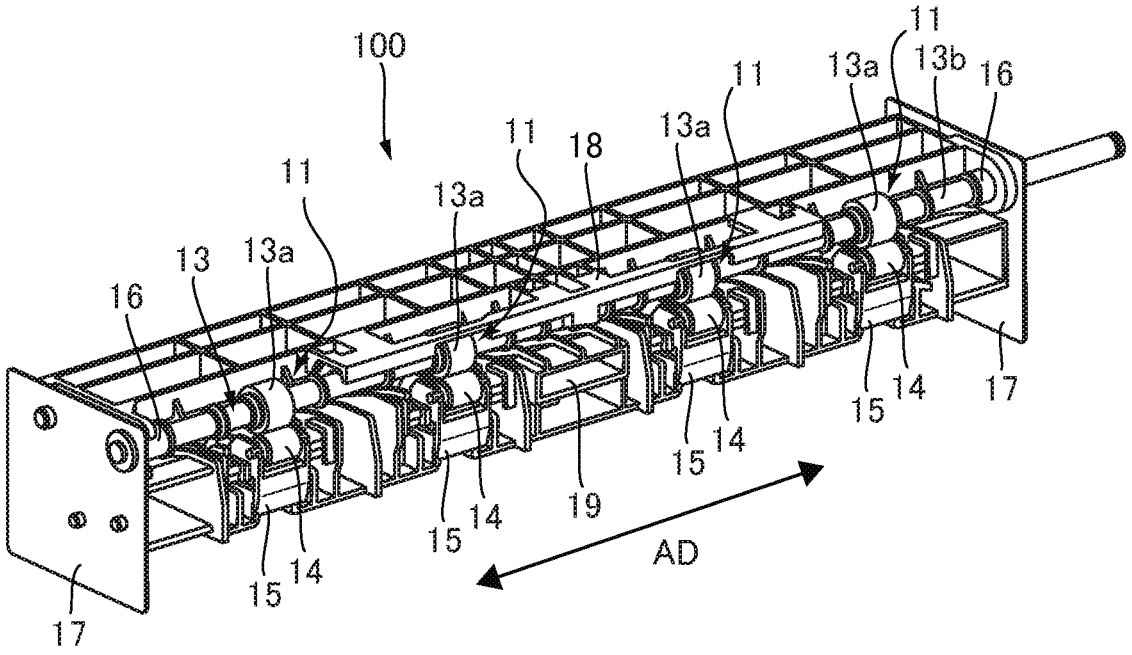
FIG. 3 is a perspective view of the sheet discharge apparatus.

Next, the sheet discharge apparatus 100 will be described in detail. As shown in FIGS. 2 and 3, the sheet discharge apparatus 100 includes a right and left side plate pair 17, which is a frame member, and an upper and a lower conveyance guide 18 and 19, both of which are supported by the right and left side plate pair 17. Above the upper conveyance guide 18, an upper cover 21 which is an exterior member is supported.

Further, the sheet discharge apparatus 100 includes a drive roller 13, which is rotatably supported by the right and left side plate pair 17 via a right and left side bearing pair 16, a plurality of driven rollers 14, and a plurality of holder members 15, which support the driven rollers 14. The drive roller 13 includes a rotating shaft 13*b* driven by a drive motor 2 (refer to FIG. 1) which is a drive source, and a plurality (4 pieces in this embodiment) of roller portions 13*a* fixed to the rotating shaft 13*b*. These plurality of roller portions 13*a* are made of a rubber material, and disposed at intervals on the rotating shaft 13*b* in an axial direction AD.

Each of the roller portions 13*a* is in contact with the driven roller 14, and the sheet discharge roller pair 11 consists of the roller portion 13*a* and the driven roller 14. Each of the driven rollers 14 is rotatably supported by the holder member 15.

Figure 4A:
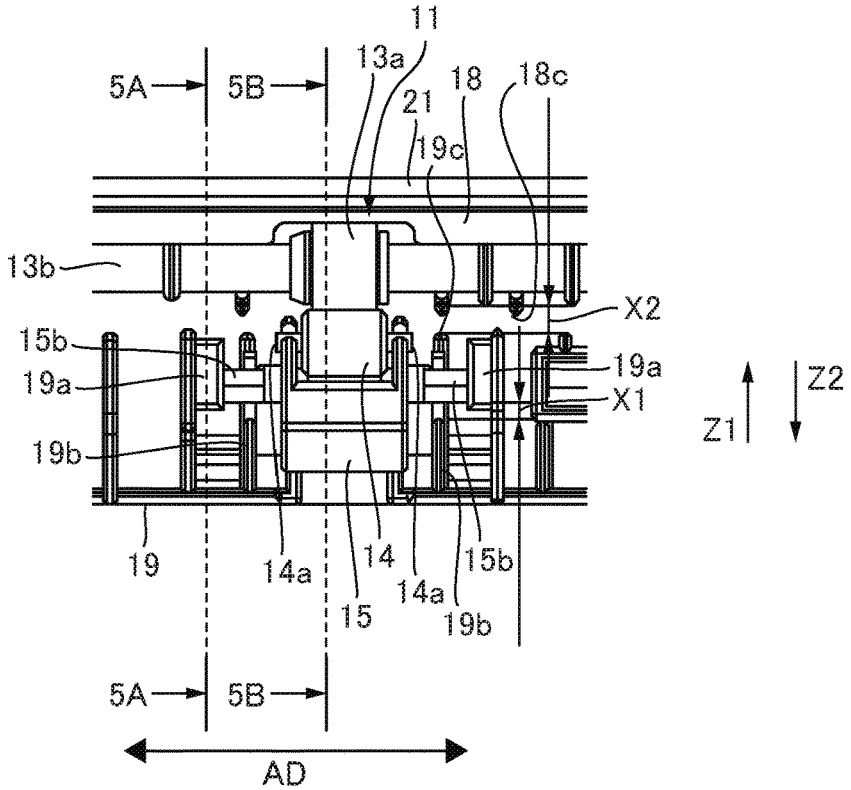
FIG. 4A is an enlarged front view of the sheet discharge apparatus showing a discharge roller pair and a holder member.
Figure 4B:
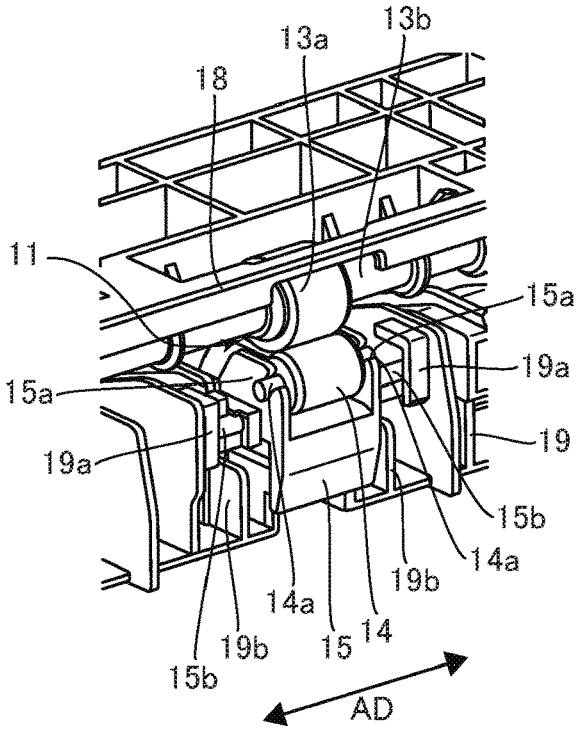
FIG. 4B is an enlarged perspective view of the sheet discharge apparatus showing the discharge roller pair and the holder member.

In particular, as shown in FIGS. 4A and 4B, rotating shafts 14*a* and 14*a* protruding from both side edges of the driven roller 14 are rotatably supported by bearing portions 15*a* and 15*a* of the holder member 15. The holder member 15 includes shaft portions 15*b* and 15*b* which protrude from both side edges of the drive roller 13 in the axial direction AD. The lower conveyance guide 19 includes, as shown in FIGS. 4A to 5B, a first rib 19*a* and a second rib 19*b* on both sides across the holder member 15 in the axial direction AD. Each of the shaft portions 15*b* and 15*b*, serving as an engagement portion, of the holder member 15 is held and interposed by the first and second ribs 19*a* and 19*b*.

Figure 5A:
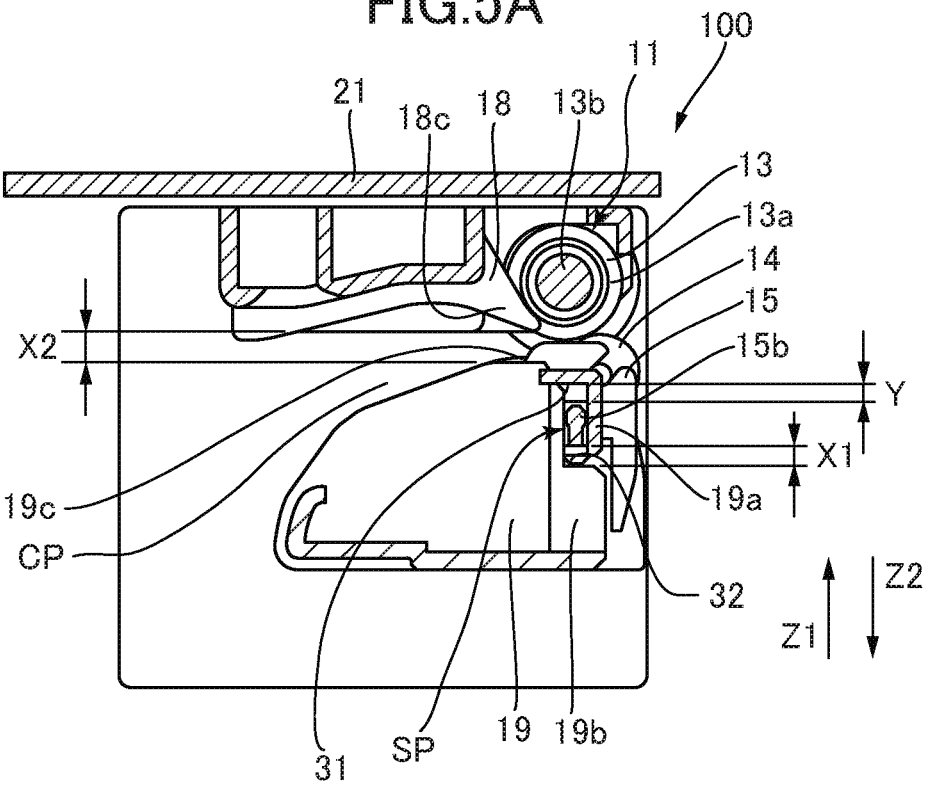
FIG. 5A is a cross-sectional view of the sheet discharge apparatus taken along the line 5A-5A of FIGS. 2 and 4A.

The first and second ribs 19*a* and 19*b* are disposed, as shown in FIG. 4A, at positions not aligned each other in the axial direction AD, and are disposed so as to face each other when viewed in the axial direction AD as shown in FIG. 5A. Further, when viewed in the axial direction AD, a moving space SP which is surrounded by the first and second ribs 19*a* and 19*b* is formed.

The shaft portion 15*b* of the holder member 15 is disposed in this moving space SP, and movable in a pressure contact direction Z1 and a separating direction Z2 in the moving space SP. That is, the holder member 15 is held by the first and second ribs 19*a* and 19*b* of the lower conveyance guide 19 in a sheet discharge direction, and supported movably in the pressure contact direction Z1 and the separating direction Z2. Further, the pressure contact direction Z1 and the separating direction Z2 are directed along a vertical direction.

As shown in FIG. 5A, the first rib 19*a*, serving as a second regulation portion, includes a first stopper portion 31, serving as a second engaged portion, which faces an upper part of the shaft portion 15*b* of the holder member 15 in the separating direction Z2. The second rib 19*b*, serving as a regulation portion, a first regulation portion, and a third regulation portion, includes a second stopper portion 32, serving as an engaged portion and a first engaged portion, which faces a lower part of the shaft portion 15*b* in the separating direction Z2. By these stopper portions, i.e. the first stopper portion 31 and the second stopper portion 32, travel stroke of the holder member 15 in the pressure contact direction Z1 and the separating direction Z2 is defined.

For example, the first stopper portion 31 regulates the holder member 15 to be movable within a range of a distance Y, described later, in the pressure contact direction Z1. The second stopper portion 32 regulates the holder member 15 to be movable within a range of a distance X1 serving as a first distance described later, in the separating direction Z2 from a position where the driven roller 14 is in contact with the drive roller 13. The second stopper portion 32 is capable to engage with the shaft portion 15*b* of the holder member 15.

Figure 5B:
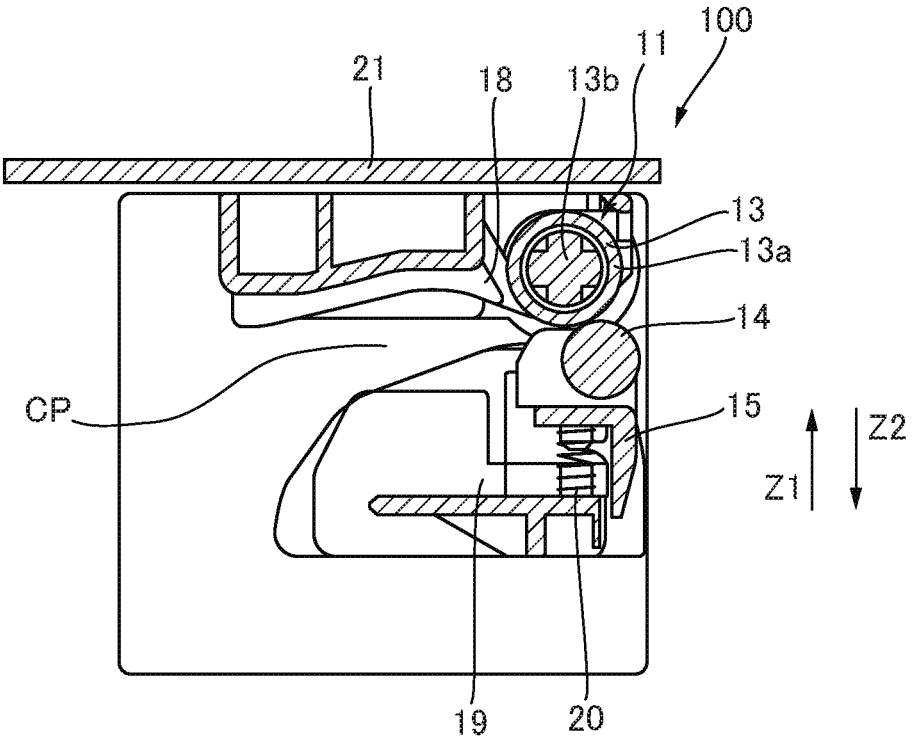
FIG. 5B is a cross-sectional view of the sheet discharge apparatus taken along the line 5B-5B of FIGS. 2 and 4A.

A compression spring 20 is, as shown in FIG. 5B, disposed between the holder member 15 and the lower conveyance guide 19, and, serving as an urging member, urges the holder member 15 in the pressure contact direction Z1. Herewith, the driven roller 14 held by the holder member 15 is brought to a pressure contact with the roller portion 13*a*, and rotatably driven by the roller portion 13*a*.

As shown in FIG. 4A, the upper conveyance guide 18, serving as a first conveyance guide, includes an upper conveyance rib 18*c*, which protrudes downward and serves as a first guide portion. The lower conveyance guide 19, serving as a second conveyance guide, includes a lower conveyance rib 19*c*, serving as a second guide portion, which faces the upper conveyance rib 18*c* and protrudes upward. That is, the upper conveyance rib 18*c* and the lower conveyance rib 19*c* are extending in a direction to approach each other.

A plurality of the upper conveyance ribs 18*c* and a plurality of the lower conveyance ribs 19*c* are respectively provided on the upper conveyance guide 18 and the lower conveyance guide 19, and form a conveyance path CP (refer to FIG. 1) through which the sheet S passes. Further, by these ribs, i.e. the upper conveyance ribs 18*c* and the lower conveyance ribs 19*c*, sliding frictions of the sheet S against the upper conveyance guide 18 and the lower conveyance guide 19 are reduced, and it is possible to convey the sheet S smoothly.

As shown in FIGS. 4A and 5A, a gap distance between the upper conveyance rib 18*c* and the lower conveyance rib 19*c* in the separating direction Z2 is a distance X2, which is a second distance. Further, a gap distance between the shaft portion 15*b* of the holder member 15 and the second stopper portion 32 of the second rib 19*b* in the separating direction Z2 is a distance X1. A gap distance between the shaft portion 15*b* of the holder member 15 and the first stopper portion 31 of the first rib 19*a* in the separating direction Z2 is the distance Y. These distances are distances in a state where the roller portion 13*a* of the drive roller 13 is in contact with the driven roller 14 and an external force does not act on the upper cover 21. In this embodiment, the distance X1 is set to be smaller than the distance X2 (X1<X2).

Figure 6:
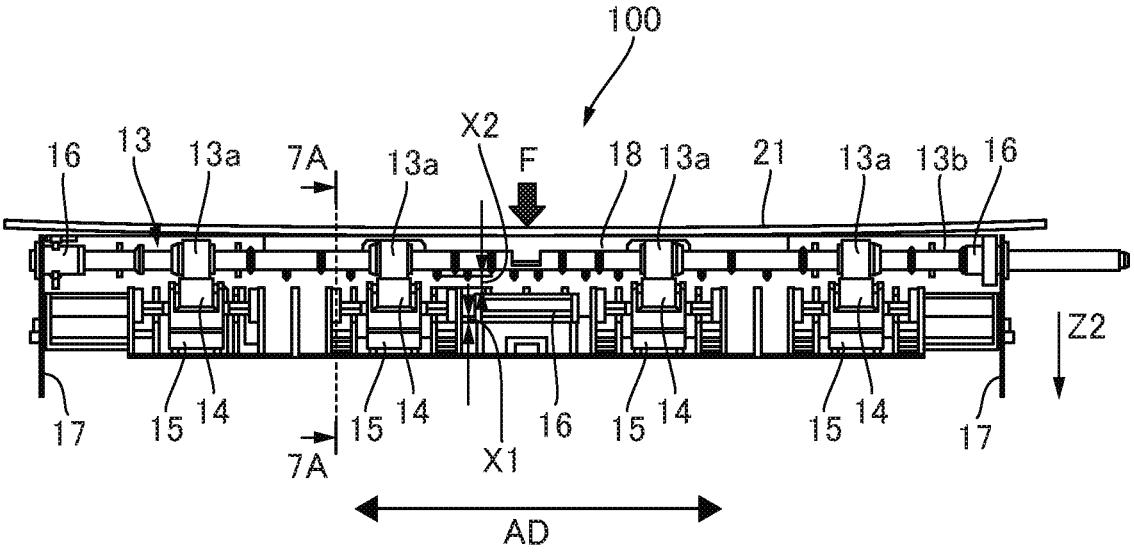
FIG. 6 is a front view of the sheet discharge apparatus in a case where an external force acts on an upper cover.

Next, a case where a large external force acts on the upper cover 21 will be described using FIGS. 6 and 7. As shown in FIG. 6, when the external force F in the separating direction Z2 acts on a center area of the upper cover 21 in the axial direction AD, the upper cover 21 deforms like a bow in the separating direction Z2. This external force F acts in a case where, for example, a user pushes the upper cover 21 by hands or puts heavy goods on the upper cover 21.

Then, by deforming the upper cover 21 in the separating direction Z2, the upper conveyance guide 18 and the drive roller 13 are also pushed and moved in the separating direction Z2. When the drive roller 13 is moved in the separating direction Z2, the holder member 15 is also moved in the separating direction Z2 via the driven roller 14 which is in contact with the roller portion 13*a* of the drive roller 13.

Figure 7:
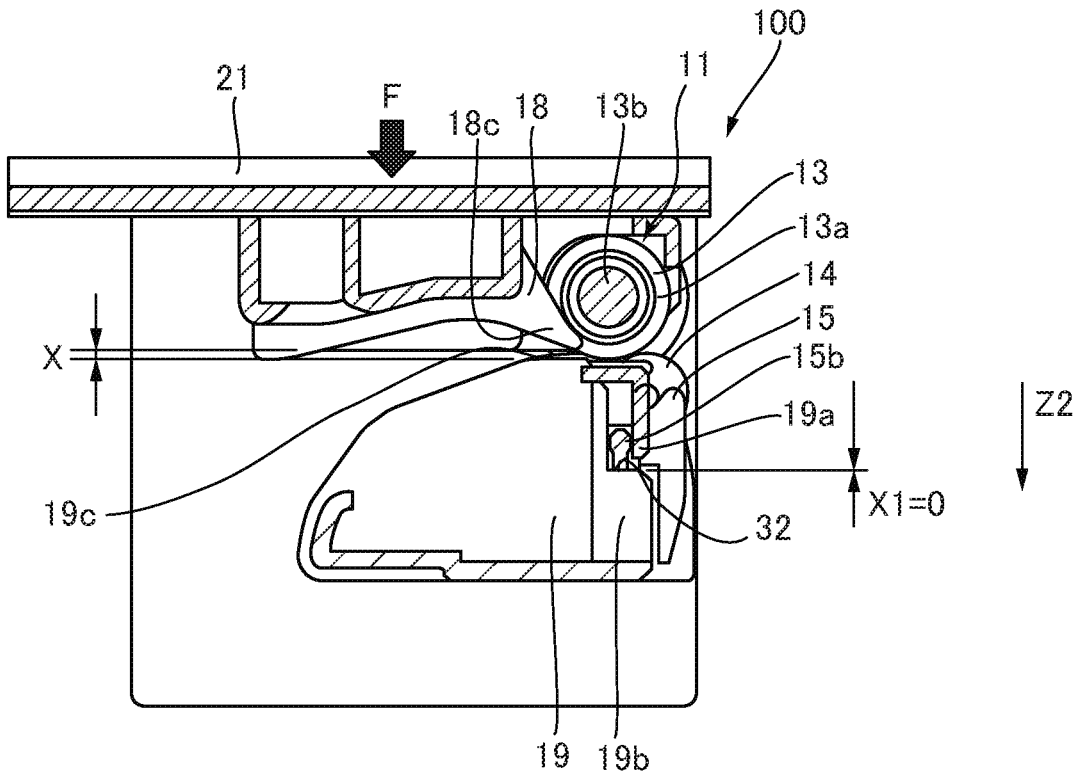
FIG. 7 is a cross-sectional view of the sheet discharge apparatus taken along the line 7A-7A of FIG. 6.

Then, the holder member 15 is, as shown in FIG. 7, movable to a position where the shaft portion 15*b* abuts on the second stopper portion 32 of the second rib 19*b*. FIG. 7 shows an example in which the shaft portion 15*b* abuts on the second stopper portion 32 and the distance X1 becomes 0. In this example, the shaft portion 15*b* abuts on the second stopper portion 32 of the second rib 19*b* while the upper conveyance rib 18*c* is in a state of detaching from the lower conveyance rib 19*c*. By abutting the shaft portion 15*b* of the holder member 15 on the second stopper portion 32, it is possible to receive the external force F at the lower conveyance guide 19, and suppress a movement of the upper conveyance guide 18.

At this time, the gap distance between the upper conveyance rib 18*c* and the lower conveyance rib 19*c* in the separating direction Z2 is narrowed by as large as the distance X1 from the distance X2 shown in FIG. 5A, and becomes a distance X. That is, following relational expression is established:

$$X=X2-X1,$$

here, X1<X2 in this embodiment, as described above, therefore, X>0.

As described above, since the gap distance X between the upper conveyance rib 18*c* and the lower conveyance rib 19*c* is secured even if the external force F acts on the upper cover 21, the sheet S is able to pass through the conveyance path CP, and it is possible to reduce an occurrence of a paper jam. This is due to a configuration in which the distance X1 is set to be smaller than the distance X2.

To be noted, while, when the shaft portion 15*b* abuts on the second stopper portion 32, it is preferable that the distance X between the upper conveyance rib 18*c* and the lower conveyance rib 19*c* becomes equal to or larger than approximately 0.5 mm, it is acceptable to set the distance X, for example, to be from 0.3 mm to 1.0 mm. By setting the distance X to be equal to or smaller than 1.0 mm, it is possible to reduce the travel strokes of the holder member 15 and accordingly a size of the apparatus.

Second Embodiment

Next, while a second embodiment of the present invention will be described, the configuration of the lower conveyance guide 19 of the first embodiment is changed in the second embodiment. Therefore, illustrations of similar configurations to the first embodiment are omitted herein, or descriptions will be provided by putting the same mark on drawings.

Figure 8:
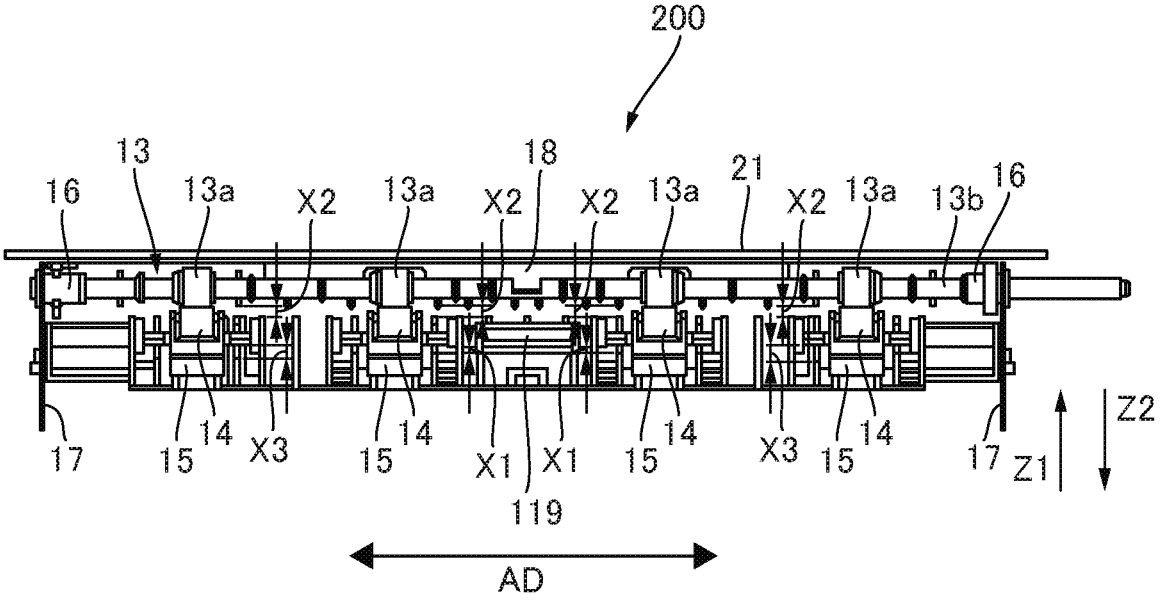
FIG. 8 is a front view of a sheet discharge apparatus according to a second embodiment.
Figure 9:
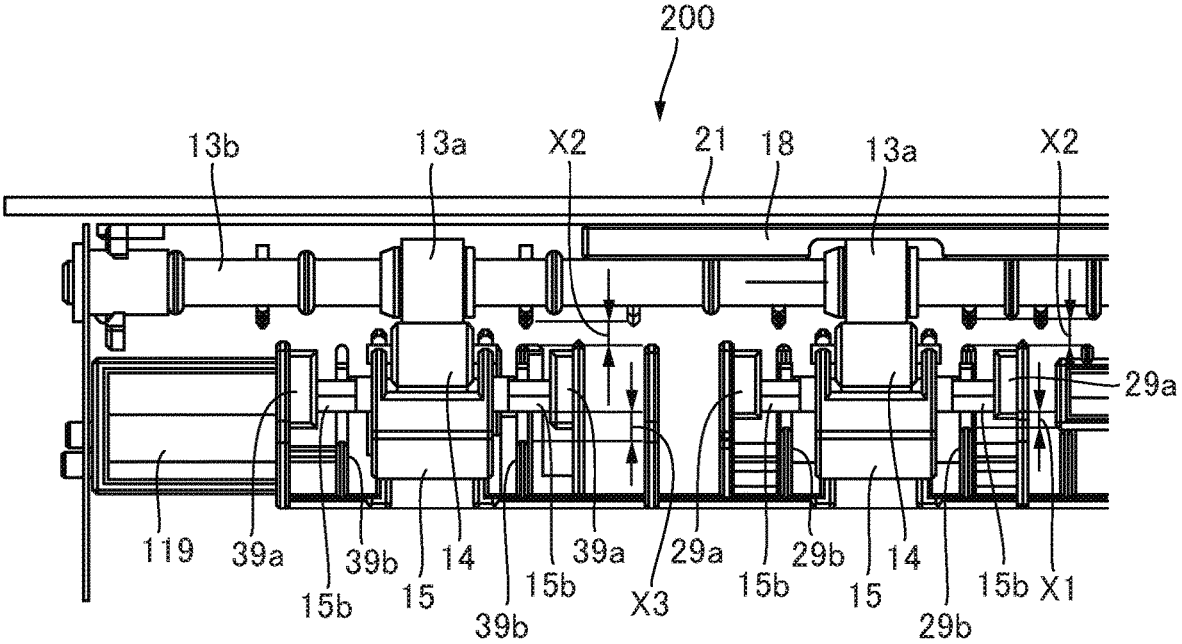
FIG. 9 is an enlarged front view of the sheet discharge apparatus.

As shown in FIGS. 8 and 9, a sheet discharge apparatus 200 according to this embodiment includes 4 pieces each of the roller portions 13*a*, the driven rollers 14, and the holder members 15. A lower conveyance guide 119 includes first ribs 29*a* and 39*a* and second ribs 29*b* and 39*b*, all of which support the holder member 15 movably in the pressure contact direction Z1 and the separating direction Z2.

Travel strokes of two of the holder members 15 in a center area in the axial direction AD are defined by the first rib 29*a* and the second rib 29*b* in the pressure contact direction Z1 and the separating direction Z2. A gap distance between the shaft portions 15*b* of each of the two holder members 15 disposed on a center area in the axial direction AD and a second stopper portion, not shown, of the second rib 29*b* is set at the distance X1. Similar to the first embodiment, the distance X1 is set to be smaller than the distance X2 (X1<X2).

On the other hand, travel strokes of two of the holder members 15 on both of outer sides in the axial direction AD are defined by the first rib 39*a* and the second rib 39*b* in the pressure contact direction Z1 and the separating direction Z2. A gap distance between the shaft portions 15*b* of each of the two holder members 15 disposed on both of the outer sides and the second stopper portion, not shown, of the second rib 39*b*, serving as a fourth regulation portion, is set at a distance X3, which is serving as a third distance. That is, the second rib 39*b* regulates a movement of each of the two holder members 15 in both of outer sides in the axial direction AD to be movable within a range of the distance X3 in the separating direction Z2 from a position where the driven roller 14 is in contact with the drive roller 13. Further, the distance X3 is configured to be larger than the distance X1 (X3>X1). Further, the distance X3 is configured to be equal to or larger than the distance X2 (X3≥X2). To be noted, it is preferable that the distance X3 is set to be equal to or smaller than twice as large as the distance X2 (X3≤X2×2). Further, two discharge roller pairs in the center area in the axial direction AD correspond to first discharge roller pairs, and two discharge roller pairs on both of the outer sides in the axial direction AD correspond to second discharge roller pairs. The second discharge roller pair mentioned above includes the roller portion 13*a*, which is a second drive roller driven by the drive motor 2, and the driven roller 14 which is a third driven roller rotatably driven by the roller portion 13*a*.

As illustrated in FIG. 6, when the external force F in the separating direction Z2 acts on the center area of the upper cover 21 in the axial direction AD, the upper cover 21 deforms like the bow in the separating direction Z2. That is, the upper cover 21 deforms larger in the center area than on both of the outer sides in the axial direction AD. Therefore, also with respect to the upper conveyance guide 18 and the drive roller 13, the center area in the axial direction AD moves larger in the separating direction Z2 than both of the outer sides. Further, since both side edges of the upper conveyance guide 18 and the drive roller 13 are held by the right and left side plate pair 17, moving amounts of both of the outer sides in the separating direction Z2 are smaller than the moving amount of the center area.

Accordingly, in this embodiment, the distance X3 is set to be larger than the distance X1, and the distance X3 is also set to be larger than the distance X2. Although the distance X3 is set as described above, two of the holder members 15 disposed on the center area in the axial direction AD abut on the second rib 29*b* of the lower conveyance guide 119 earlier than two of the holder members 15 disposed on both of the outer sides. Herewith, it is possible to receive the external force F at the lower conveyance guide 119, and suppress the movement of the upper conveyance guide 18, and secure the gap distance X (X>0) in the separating direction Z2 between the upper conveyance rib 18*c* and the lower conveyance rib 19*c*.

As described above, since the gap distance between the upper conveyance rib 18*c* and the lower conveyance rib 19*c* is secured to be as large as the distance X, the sheet S is able to pass through the conveyance path CP, and it is possible to suppress the occurrence of the paper jam.

Further, by setting the distance X3 equal to or larger than the distance X2, it is possible to enlarge the travel stroke in the separating direction Z2 of the holder members 15 on both of the outer sides in the axial direction AD, and enhance a degree of freedom in a setting of the compression spring 20.

Further, when the sheet S curled at both of the edges in the axial direction AD passes through the sheet discharge roller pair 11, a force to push down the driven roller 14 is larger on both of the outer sides than in the center area in the axial direction AD. Therefore, by setting the distance X3 equal to or larger than the distance X2, it is possible to reduce damage on a curled sheet S and smoothly discharge the sheet S.

Further, in a case where the lower conveyance guide 119 is configured to be capable of connecting to and disconnecting from the apparatus to facilitate jam treatment, resistance at a connection of the lower conveyance guide 119 becomes larger in a case where the travel strokes of the holder member 15 is small. However, by enlarging the travel strokes of the holder members 15 in the separating direction Z2 on both of the outer sides in the axial direction AD, the resistance at the connection of the lower conveyance guide 119 becomes smaller, and it is possible to improve operability of a connection work.

Third Embodiment

Next, while a third embodiment of the present invention will be described, a first driven roller 23 and a second driven roller 24 are used in the third embodiment instead of the driven roller 14 of the first embodiment. Thus, illustrations of similar configurations to the first embodiment are omitted herein, or descriptions will be provided by putting the same mark on drawings.

Figure 10:
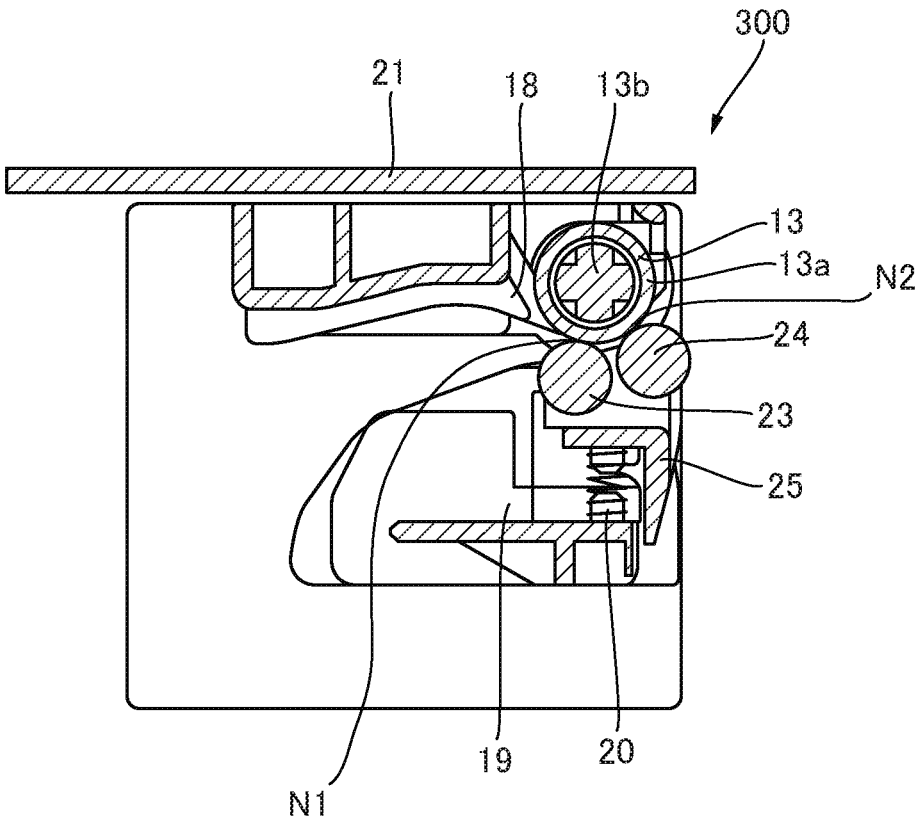
FIG. 10 is a cross-sectional view of a sheet discharge apparatus according to a third embodiment.
Figure 11:
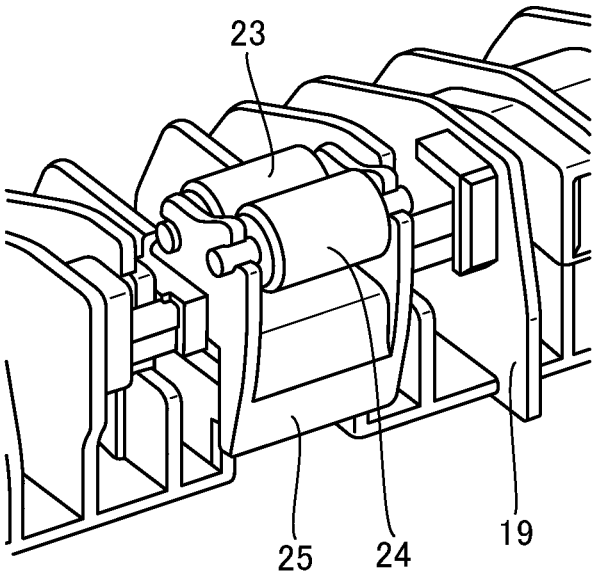
FIG. 11 is a perspective view showing a first and a second driven roller.

As shown in FIGS. 10 and 11, a sheet discharge apparatus 300 according to this embodiment includes the drive roller 13, the first and second driven rollers 23 and 24, both of which are in contact with the roller portion 13*a* of the drive roller 13, and a holder member 25. The second driven roller 24 is disposed downstream of the first driven roller 23 in the sheet discharge direction. The holder member 25 rotatably holds the first and second driven rollers 23 and 24, and also is urged toward the roller portion 13*a* by the compression spring 20.

Thus, it is possible to smoothly introduce the sheet S into a nip portion N1 formed between the roller portion 13*a* of the drive roller 13 and the first driven roller 23. Further, it is possible to enlarge a discharge angle (attack angle) of a nip portion N2 formed between the roller portion 13*a* and the second driven roller 24. Further, it is possible to correct a curl of the sheet S by these rollers, i.e. the roller portion 13*a*, the first driven roller 23, and the second driven roller 24.

Alternatives

To be noted, while, in any of the configurations described above, a movement of the holder member in the separating direction Z2 is regulated by the second stopper portion of the second rib provided on the lower conveyance guide, it is not limited to this. For example, it is acceptable to regulate the movement of the holder member in the separating direction Z2 by a stopper member disposed independently from the lower conveyance guide 19.

Further, while, in any of the configurations described above, 4 pieces each of the roller portions 13*a* and the holder members 15 or 25 are disposed, it is not limited to this. For example, it is acceptable to dispose these members from one through three or more than five pieces each.

Further, while, in any of the configurations described above, the holder member 15 or 25 is configured to slide in the pressure contact direction Z1 and the separating direction Z2, it is not limited to this. For example, it is acceptable to configure the holder member 15 rotatable around an axis extending in parallel to the axial direction AD as a center.

Further, in any of the configurations described above, any shape is acceptable to the shaft portion of the holder member and the first and second ribs. For example, it is acceptable to form a long hole portion, which extends in the pressure contact direction Z1 and the separating direction Z2, on the lower conveyance guide, and regulate the movement of the shaft portion in the pressure contact direction Z1 and the separating direction Z2 by this long hole portion.

Further, while the printer 50 of the electrophotographic system is used for the descriptions of any of the configurations described above, the present invention is not limited to this. For example, it is possible to apply the present invention to an image forming apparatus of an inkjet system which forms the image on the sheet by ejecting a liquid ink from a nozzle.

Other Embodiments

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-146510, filed Aug. 8, 2019, which is hereby incorporated by reference herein in its entirety.

What is claimed is:

1. A sheet discharge apparatus comprising:

a discharge roller pair configured to discharge a sheet, the discharge roller pair including a drive roller driven by a drive source and a driven roller rotatably driven by the drive roller;

a holder member configured to rotatably hold the driven roller;

a first conveyance guide including a first guide portion and configured to rotatably support the drive roller;

a second conveyance guide configured to support the holder member movably in a separating direction where the holder member separates from the drive roller, the second conveyance guide including a second guide portion which forms a conveyance path, together with the first guide portion, through which the sheet passes;

a regulation portion configured to regulate a movement of the holder member to be movable within a range of a first distance in the separating direction from a position where the driven roller is in contact with the drive roller;

an exterior member forming a top surface of the sheet discharge apparatus, the exterior member being supported by the first conveyance guide; and an outside discharge roller pair, an outside holder member, and an outside regulation portion, all of which are disposed outside the discharge roller pair in an axial direction of the drive roller, wherein the first distance is smaller than a second distance which is a distance between the first guide portion and the second guide portion in the separating direction, wherein the exterior member is configured to be deformed in the separating direction in a case where an external force acts on the exterior member, wherein the first conveyance guide moves in the separating direction in response to deformation of the exterior member in the separating direction, wherein, in a case where the external force acts on the exterior member in the separating direction, the holder member comes into contact with the regulation portion in a state where the first guide portion is separated from the second guide portion, wherein the outside discharge roller pair includes an outside drive roller driven by the drive source, and an outside driven roller rotatably driven by the outside drive roller, wherein the outside holder member is configured to rotatably hold the outside driven roller, and is movably supported in the separating direction by the second conveyance guide, and wherein the outside regulation portion is configured to regulate a movement of the outside holder member to be movable within a range of a third distance, which is larger than the first distance, in the separating direction from a position where the outside driven roller is in contact with the outside drive roller.

2. The sheet discharge apparatus according to claim 1, wherein the holder member comprises an engagement portion, wherein the regulation portion is provided on the second conveyance guide, and includes an engaged portion configured to engage with the engagement portion, and wherein the engagement portion is separated from the engaged portion by the first distance in a state where the driven roller is in contact with the drive roller.

3. The sheet discharge apparatus according to claim 2, wherein the regulation portion and the engaged portion are respectively a first regulation portion and a first engaged portion, wherein the sheet discharge apparatus further comprises a second regulation portion provided on the second conveyance guide, the second regulation portion including a second engaged portion configured to engage with the engagement portion, and wherein the first regulation portion and the second regulation portion are configured to hold the engagement portion so as to interpose the engagement portion in a sheet discharge direction, and support the engagement portion movably between the first engaged portion and the second engaged portion.

4. The sheet discharge apparatus according to claim 1, further comprising an urging member configured to urge the holder member such that the driven roller is brought close to the drive roller.

5. The sheet discharge apparatus according to claim 1, wherein the first guide portion is a rib extending in a first direction, and wherein the second guide portion is a rib extending in a second direction opposite to the first direction so as to approach the first guide portion.

6. The sheet discharge apparatus according to claim 1, wherein the driven roller is a first driven roller, and wherein the sheet discharge apparatus further comprises a second driven roller disposed downstream of the first driven roller in a sheet discharge direction, the second driven roller being rotatably supported by the holder member and being configured to be rotatably driven by the drive roller.

7. An image forming apparatus comprising:

an image forming unit configured to form an image on a sheet; and the sheet discharge apparatus according to claim 1 configured to discharge the sheet on which the image has been formed by the image forming unit.

8. The sheet discharge apparatus according to claim 1, wherein the third distance is equal to or larger than the second distance, and is equal to or smaller than twice as large as the second distance.

9. The sheet discharge apparatus according to claim 1, wherein the separating direction is a direction along a vertical direction.

10. The sheet discharge apparatus according to claim 1, wherein, in a case where the external force does not act on the exterior member, the holder member is separated from the regulation portion.

* * * * *